US005996117A

United States Patent [19]

Goldsmith et al.

[11] Patent Number: 5,996,117

[45] Date of Patent: *Dec. 7, 1999

[54] ATHLETIC GLOVE THUMB PROTECTOR

[75] Inventors: Edward M. Goldsmith, Granada Hills; Duncan G. Robins, Woodland Hills, both of Calif.

[73] Assignee: Jas D. Easton, Inc., Van Nuys, Calif.

[ * ] Notice: This patent is subject to a terminal disclaimer.

[21] Appl. No.: 09/145,587

[22] Filed: Sep. 2, 1998

Related U.S. Application Data

[63] Continuation of application No. 08/893,476, Jul. 11, 1997, Pat. No. 5,884,329.

[51] Int. Cl.[6] ..... A41D 13/08

[52] U.S. Cl. ..... 2/16; 2/161.1

[58] Field of Search ..... 2/16, 21, 160, 2/161.1, 163, 159

[56] References Cited

U.S. PATENT DOCUMENTS

| | | | |
|---|---|---|---|
| 932,901 | 8/1909 | Ramsey | 2/21 |
| 2,388,330 | 11/1945 | Jungmann | 2/16 |
| 3,626,515 | 12/1971 | Murray | 2/16 |
| 4,137,572 | 2/1979 | Jansson et al. | 2/16 |
| 4,438,532 | 3/1984 | Campanella et al. | 2/16 |
| 4,445,507 | 5/1984 | Eisnberg | 2/159 |
| 4,524,464 | 6/1985 | Primiano et al. | 2/163 |
| 4,658,441 | 4/1987 | Smith | 2/16 |
| 4,787,376 | 11/1988 | Eisenberg | 2/21 |
| 5,063,613 | 11/1991 | Brown | 2/21 |
| 5,083,314 | 1/1992 | Andujar | 2/18 |
| 5,107,544 | 4/1992 | Capatosto | 2/16 |
| 5,237,703 | 8/1993 | Brine et al. | 2/16 |
| 5,237,709 | 8/1993 | Brine et al. | 2/16 |
| 5,561,856 | 10/1996 | Pesco | 2/16 |

*Primary Examiner*—Michael A. Neas
*Attorney, Agent, or Firm*—Lyon & Lyon LLP

[57] ABSTRACT

This invention relates to a thumb protector for a protective athletic glove, such as used in hockey, lacrosse, and motorcycle racing. The thumb protector involves two elements secured dorsally to the thumb stall and thumb receiving area of the glove, which cooperate to allow opposable thumb movement while still providing superior protection against external blows and injury due to hyper-extension and over-extension. As another aspect of the invention, the thumb-piece of the thumb protector is ergonomically configured to approximate the contour the metacarpalphalangeal joint will typically assume when the wearer is lightly gripping an athletic stick or handlebar.

3 Claims, 4 Drawing Sheets

ATHLETIC GLOVE THUMB PROTECTOR

This is a continuation of application Ser. No. 08/893,476 filed Jul. 11, 1997 now U.S. Pat. No. 5,884,329.

FIELD OF THE INVENTION

This invention relates generally to protective athletic gloves for contact stick sports (such as hockey and lacrosse) and motorcycle racing (or motorcross) and is more particularly concerned with an improved thumb protector for such gloves.

BACKGROUND OF THE INVENTION

Hockey and lacrosse are contact sports where sticks are integral elements of the game, and it is important that the hands of the players be protected. The hands must be protected against not only the powerful external blows they often receive but also against hyper-extending and over-extending the digits, particularly the thumb. It is similarly necessary to protect the hands in motorcycle racing. Conventional protective gloves are constructed with individual finger stalls and impact resistant padding covering the dorsal surface of each finger and the back and sides of the hand. The protective padding typically extends below the hand to the wrist area, and can even extend several inches up the player's forearm. Protective gloves also typically use stiff, impact resistant sheet form elements as protective components in such glove constructions.

Protective padding on athletic gloves often restricts flexibility. Accordingly, it is also conventional to fabricate such gloves with segmented padding in order to somewhat improve hand and finger flexibility. The stalls for the second through fifth digits are often shaped in a precurled position that emulates the gripping position the player will be using. Gripping the stick or handlebars is thereby made more efficient because the wearer need not overcome the stiffness of the glove simply to achieve and maintain the natural gripping position.

The human thumb, however, is in opposition to the fingers, and its skeletal structure is significantly different from that of the fingers. The thumb, particularly the metacarpalphalangeal joint (and also, to a lesser degree, the carpalmetacarpal joint), is highly susceptible to injury from hyper-extension and over-extension, which result when the thumb is forced outside of its normal range of movement. This bending can strain or tear the ligaments of the thumb joints, and particularly the ulnar collateral ligament, which is connected around the metacarpalphalangeal joint. These injuries can be very serious, even career ending in some circumstances. Surgery is required in severe cases. Generally, the injured hand never completely recovers the joint mobility it enjoyed prior to the injury.

Nevertheless, opposable thumb movement is critical to achieving a functional grip on a hockey stick, lacrosse stick, or motorcycle handlebar, and the thumb-protecting structures employed in the prior art do not provide an acceptable combination of protection and flexibility in the thumb portion of the glove. Typical of such thumb protectors are those disclosed in U.S. Pat. No. 3,626,515 to Murray, issued Dec. 14, 1971, and U.S. Pat. No. 4,137,572 to Jansson et al., issued Feb. 6, 1979, which are hereby incorporated by reference as if they were fully set forth herein. The Murray patent discloses a thumb guard comprising an elongate, stiff, unbreakable center or core insert sandwiched between layers of a shock absorbing material. The length of this thumb guard is shown to be sufficient to cover both phalanges as well as at least a portion of the metacarpal of the thumb. Murray apparently recognizes the inflexible nature of this thumb guard and in response thereto, does not attach it directly to the thumb encasing portion of the glove. Instead, the thumb encasing portion of the glove is rendered moveable independently of the thumb guard by attachment thereto with a short strap. This means, however, that as the player's thumb is curled around the stick shaft in a gripping position, at least the distal portion of the thumb moves away from the overlying thumb guard and the protection afforded thereby.

In the Jansson patent, a thumb protective element is disclosed which is similar in construction to the stiff elongate sandwich structure employed in Murray. In Jansson, however, this unarticulated stiff protective element extends proximally and uninterruptedly from the tip of the thumb stall into the wrist protective cuff thereof. In addition, the thumb protective element is stitched directly to the thumb stall of the glove. Thus, the thumb portion of the Jansson glove appears to provide even less flexibility than that of the Murray glove. Today, many professional hockey teams require the players to use a protective member like that disclosed in Jansson because of the superior protection it affords. However, this protective element severely impairs flexibility. Accordingly, players often cut or break the required thumb protective element at the wrist area, so that they are effectively using a shorter protective element such as that disclosed in Murray.

Multiple piece thumb protectors have been used in the prior art with the goal of achieving improved flexibility without sacrificing protection. U.S. Pat. No. 5,237,703 to Brine et al., issued Aug. 24, 1993, which is hereby incorporated by reference as if it were fully set forth herein, discloses a thumb protective construction employing a distal protective element overlying the phalanges of the thumb and a proximal protective element overlying the metacarpal bone of the thumb. The two protective elements are secured in proximal relation with an intermediate arcuately shaped element disposed thereover. However, it is believed that to the extent this construction provides any real thumb flexibility, it can do so only by failing to provide adequate protection against hyper-extension and over-extension of the thumb. Conversely, it is similarly believed that for the Brine thumb protector to meaningful protect against hyper-tension and over-extension, it can only do so at the sacrifice of thumb flexibility.

A further drawback of the prior art thumb protectors is that they tend to be designed in a straight configuration. As explained, the finger stalls of modern gloves come in a precurled disposition to accommodate the wearer's natural gripping position. Nevertheless, similar accommodations have not heretofore been made for the thumb even though it too is bent when gripping athletic sticks or handlebars.

OBJECTS OF THE INVENTION

It is a principal object of the invention to provide a novel and improved protective athletic glove comprising a novel thumb protector. Other objects and advantages of the present invention will in part be obvious and will in part appear hereinafter.

SUMMARY OF THE INVENTION

The present invention is directed to an improved thumb protector in a protective athletic glove for a hand. Such gloves typically have a thumb receiving section and a thumb stall. In its preferred embodiment, the present thumb protector comprises a thumb-piece and a wrist-piece, each fashioned of an impact resistant material. The thumb-piece has a distal section, a proximal section, and a ridge. The distal section has a length sufficient to overlie the phalanges of the thumb. The proximal section has a length sufficient to overlie at least the metacarpal bone of the thumb. The distal and proximal sections are joined at an obtuse angle so that the thumb-piece is ergonomically configured to approximate the contour the first metacarpalphalangeal joint will typically assume when the wearer is lightly gripping an athletic stick or handlebar. The ridge lies on the dorsal side of the thumb-piece at or near the junction of the distal and proximal sections.

The wrist-piece has a length sufficient to overlie the metacarpal bone of the thumb, the wrist area, and at least a portion of the radius. The thumb-piece and wrist-piece are placed in a cooperative arrangement dorsally to the thumb stall and thumb receiving section whereby the wrist-piece overlies the proximal section of the thumb-piece. This arrangement contemplates that the ridge of the thumb-piece will lie adjacent to the distal end of the wrist-piece. This arrangement provides the wearer with an improved flexibility for making opposable thumb movement, but still provides superior protection against external blows and injuries resulting from hyper-extension and over-extension.

DETAILED DESCRIPTION OF THE INVENTION

Figure 1:
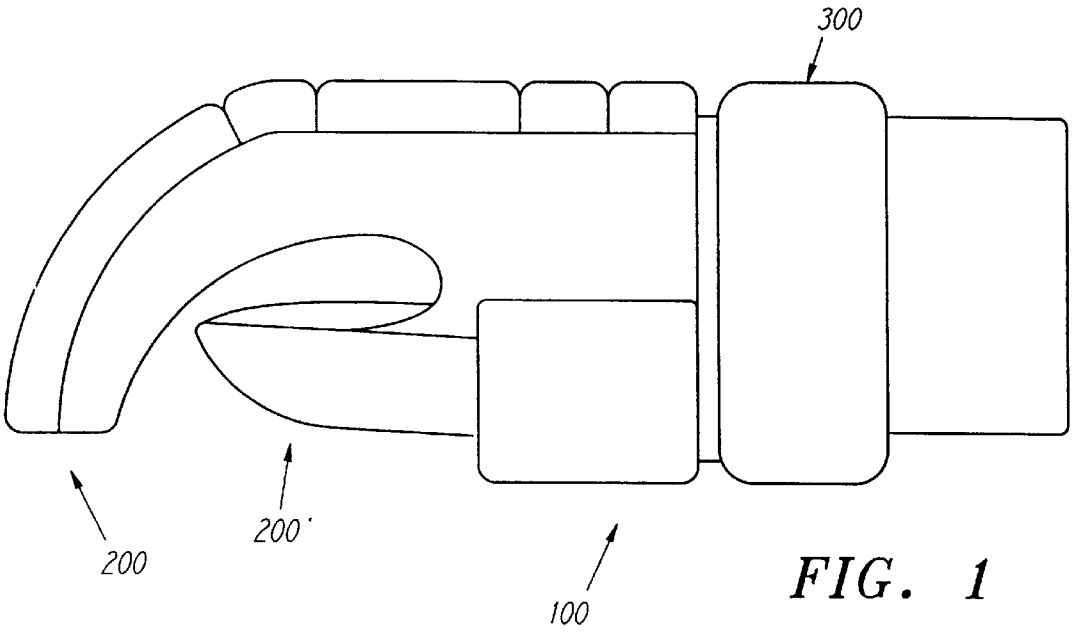
FIG. 1 is a radial-dorsal view of a protective athletic glove for a right hand.
Figure 2:
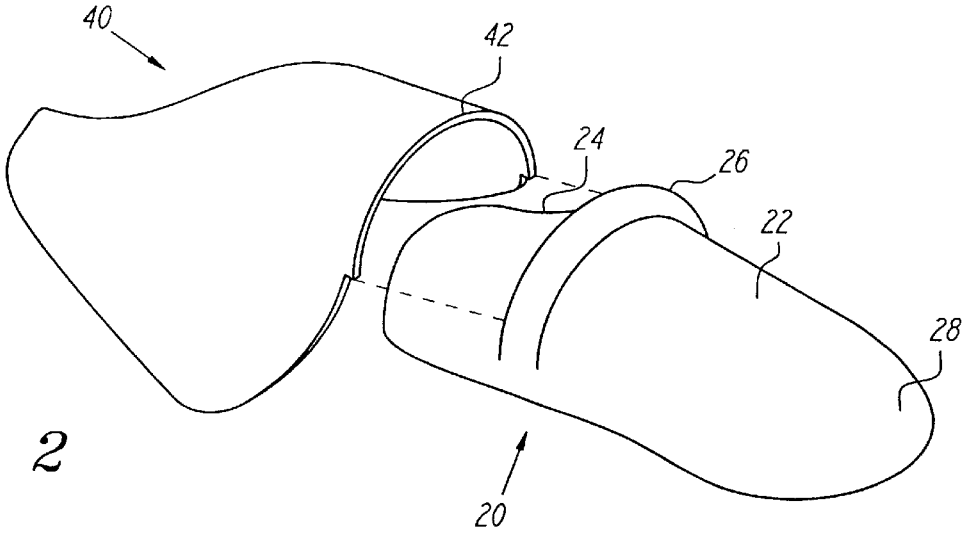
FIG. 2 is a radial-dorsal view of a thumb-piece and wrist-piece for a right-hand thumb protector, shown separated.
Figure 3:
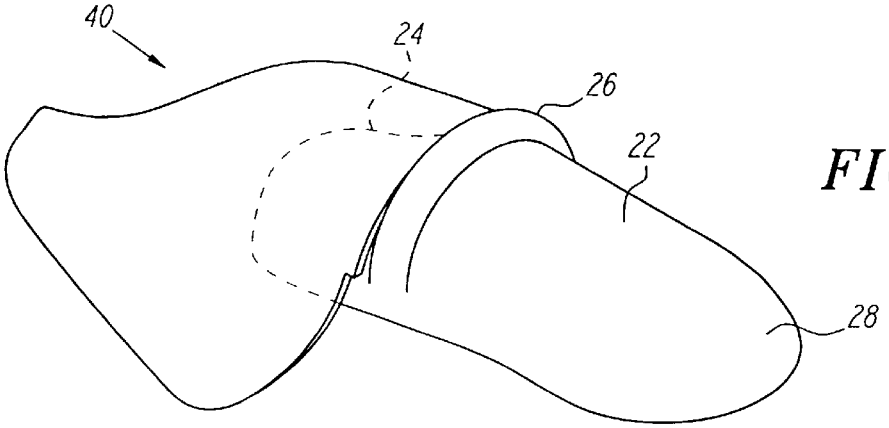
FIG. 3 is a radial-dorsal view of a thumb-piece and wrist-piece for a right-hand thumb protector, shown in cooperation.
Figure 4:
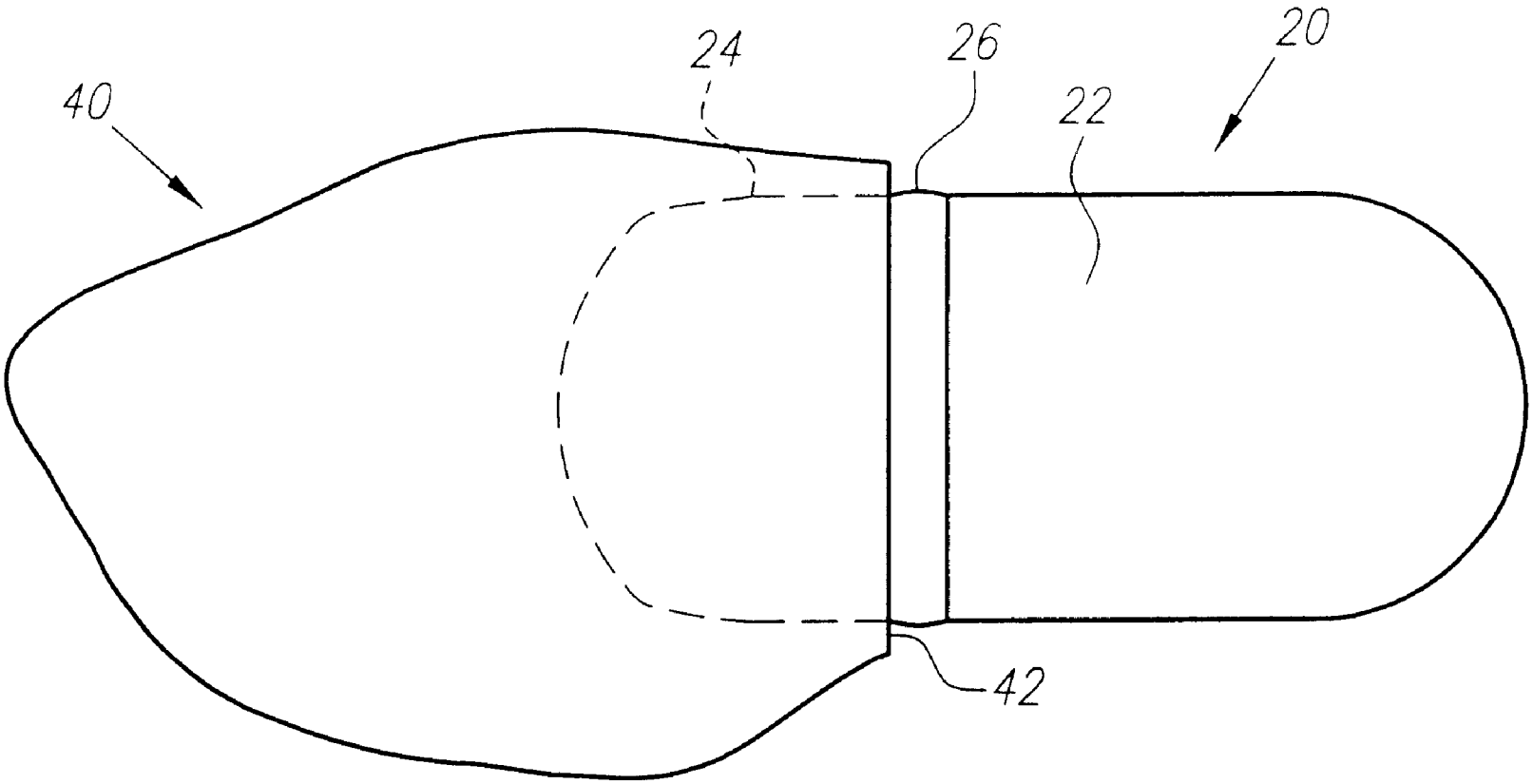
FIG. 4 is a radial view of a thumb-piece and wrist-piece for a right-hand thumb protector, shown in cooperation.
Figure 5:
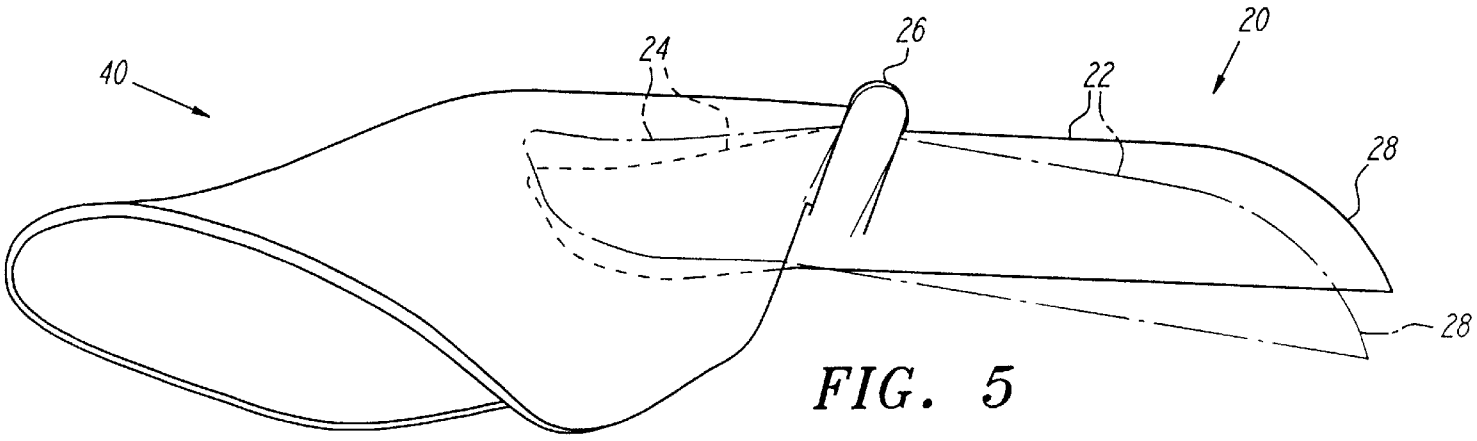
FIG. 5 is an radial-dorsal view of a thumb-piece and wrist-piece for a right-hand thumb protector, with the motion of the thumb-piece demonstrated in phantom.
Figure 6:
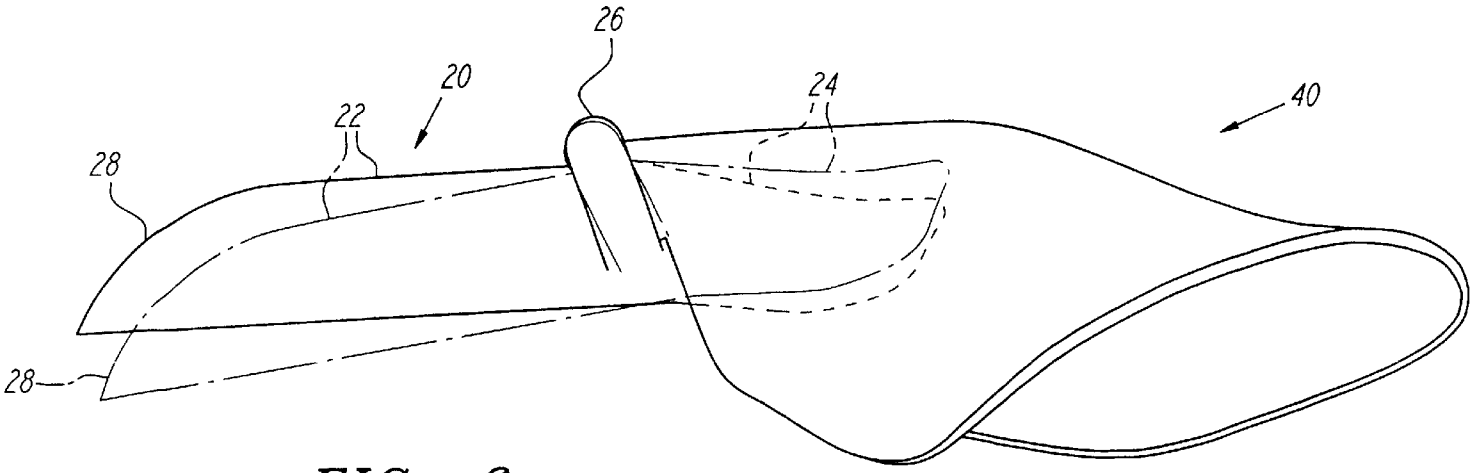
FIG. 6 is a radial-palmer view of a thumb-piece and wrist-piece for a right-hand thumb protector, with the motion of the thumb-piece demonstrated in phantom.
Figure 7:
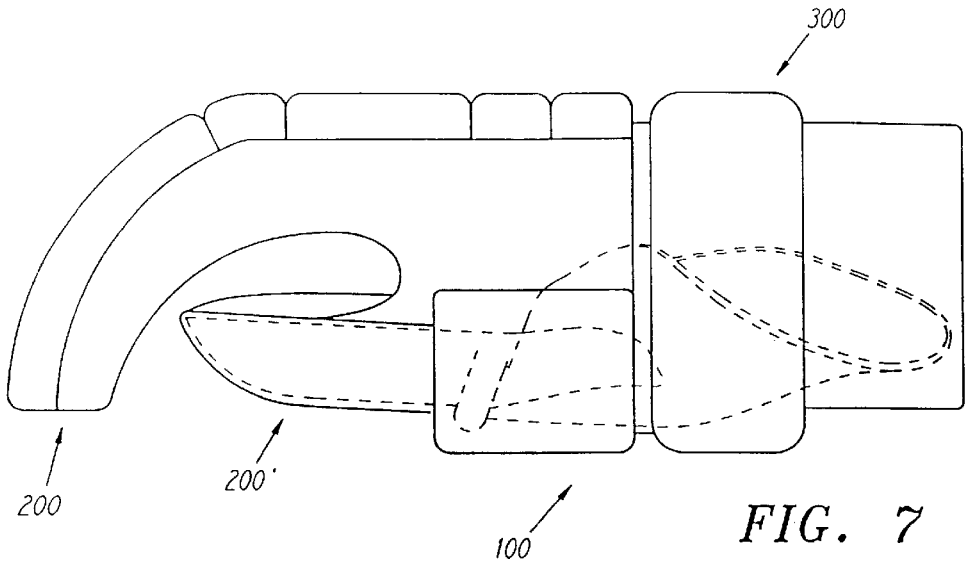
FIG. 7 is a radial-dorsal view of a thumb-piece and wrist-piece as they fit into a protective athletic glove for a right hand.
Figure 8:
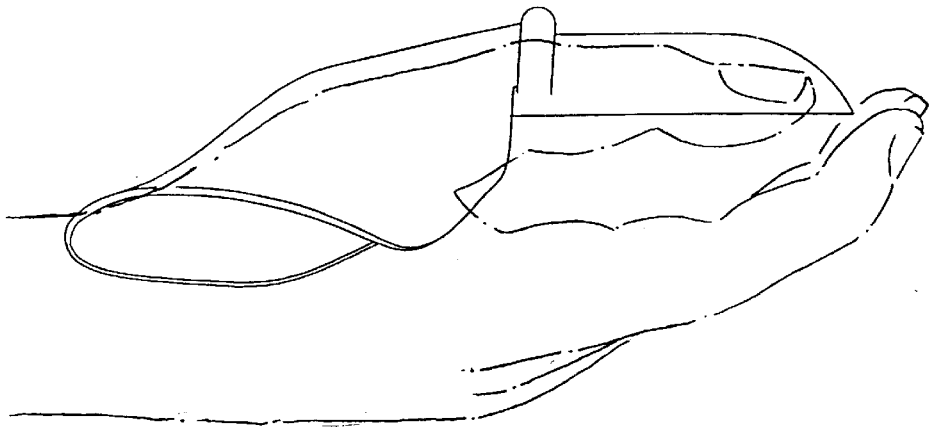
FIG. 8 is a view of a thumb-piece and wrist-piece as they cooperate with a hand.
Figure 9:
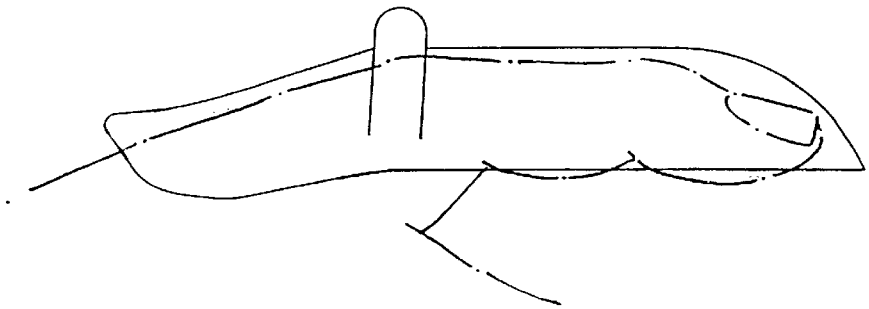
FIG. 9 is a view of a thumb-piece as it cooperates with a thumb.

Turning now to the drawings, wherein like reference numerals refer to like structures, a protective athletic glove generally comprises finger stalls 200, including a thumb stall '200, and a thumb receiving section 100, which generally includes a protective cuff 300. The present invention relates specifically to an improved thumb protector for such a protective athletic glove.

In the preferred embodiment of the present invention, the thumb protector comprises a distal protective component (the thumb-piece) 20 and a proximal protective component (the wrist-piece) 40 disposed in cooperating relation in the dorsal aspect of the thumb stall '200 and thumb receiving section 100 of the glove. The thumb-piece 20 has a distal section 22, a proximal section 24, and, in the preferred embodiment, a ridge 26. The distal section 22 is long enough to overlie the phalanges of the thumb. The proximal section 24 is long enough to overlie at least the metacarpal bone of the thumb. The distal section 22 and proximal section 24 are joined at an obtuse angle so that the thumb-piece 20 is ergonomically configured to approximate the contour the first metacarpalphalangeal joint will typically assume when the wearer is lightly gripping an athletic stick or handlebar. When the thumb-piece 20 has a ridge 26, the ridge 26 is located at or near the juncture of the distal section 22 and proximal section 24 on the dorsal side of the thumb-piece 20.

The wrist-piece 40 is long enough to overlie the metacarpal bone of the thumb, the wrist area, and at least a portion of the radius. The thumb-piece 20 and wrist-piece 40 are placed in a cooperative arrangement dorsally to the thumb stall '200 and thumb receiving section 100 whereby the wrist-piece 40 overlies the proximal section 24 of the thumb-piece 20. This arrangement provides the wearer with added flexibility when making the opposable thumb movement necessary to grip an object. However, because the thumb-piece 20 and wrist-piece 40 are secured rather closely in the protective glove, they cooperate to protect the wearer against external blows, and injuries resulting from hyper-extension of the thumb (toward the wrist area) and over-extension of the thumb (toward the palm).

The risk of over-extension is reduced by the action of the proximal section 24 of the thumb-piece 20 stopping up against the underside (or palmar aspect) of the wrist-piece 40, which effectively transfers the force along the entire cuff 300 of the glove. The risk of hyper-extension is reduced in two ways. The thumb-piece 20, upon receipt of a hyper-extending force, will transfer the force away from the vulnerable metacarpalphalangeal joint to the sturdier joints of the wrist area (e.g. the carpometacarpal joint). This action alone provides substantial protection against hyper-extension. The risk of hyper-extension is further limited by the cooperation of the thumb-piece 20 with the wrist-piece 40. This cooperation dramatically reduces the risk of hyper-extension of the carpometacarpal joint, or any of the wrist-area joints, by transferring the force, via the wrist-piece 40, to the forearm, which is exceptionally sturdy. In the preferred embodiment (where the thumb-piece 20 has a ridge 26), the distal end 42 of the wrist-piece 40 lies adjacent to the ridge 26. It is an intended consequence of this arrangement that the ridge 26 will stop up against the distal end 42 of the wrist-piece 40 when the thumb receives a force tending to radially displace it, thereby more effectively transferring the force, via the wrist-piece 40, to the forearm and even further reducing the risk of hyper-extending the thumb.

In another aspect of the preferred embodiment, the thumb-piece 20 has a closed distal end 28, and both the distal section 22 and proximal section 24 of the thumb-piece 20 have a generally concave geometry. By these features, the thumb-piece 20 at least partially encloses the lateral and distal aspects of a thumb received into the thumb stall '200 and the lateral aspects of the soft tissue overlying the first metacarpal bone.

In yet another aspect of the preferred embodiment, the wrist-piece 40 has a gently arcuate cross-sectional geometry which approximates the curvature of the soft tissue overlying the first metacarpal bone and the wrist area. In this embodiment, the wrist-piece 40 is not symmetrical along its radial axis. Rather, the dorsal aspect of the wrist-piece 40 extends to cover at least a portion of the second metacarpal bone, providing further protection against external blows. Thus extending the wrist-piece 40 across the dorsal aspect of the hand also adds stability to the interaction between the thumb-piece 20 and wrist-piece 40, which in turn enhances the protection against the injuries that result from the thumb being forced outside its normal range of motion. The palmer aspect of the wrist-piece 40 extends slightly less than the dorsal aspect so as to not interfere with the palmer aspect of the hand when gripping.

In another embodiment of the invention, the thumb protector comprises the improved thumb-piece 20, without the wrist-piece 40. As described above, the thumb-piece 20, alone, is a substantial improvement over the prior art because it is ergonomically configured to approximate the contour the first metacarpalphalangeal joint will typically assume when the wearer is lightly gripping an athletic stick or handlebar. The thumb-piece 20, alone, also provides substantial protection against hyper-tension of the thumb because, upon receipt of a hyper-extending force, the thumb-piece 20 will transfer the force away from the vulnerable metacarpalphalangeal joint to the sturdier joints of the wrist area (e.g. the carpometacarpal joint). This action provides substantial protection against hyper-extension. As explained, when the thumb-piece 20 has a ridge 26, the ridge 26 is located at or near the juncture of the distal section 22 and proximal section 24 on the dorsal side of the thumb-piece 20.

The foregoing specification and the drawings forming part hereof are illustrative in nature and demonstrate certain preferred embodiments of the invention. It should be recognized and understood, however, that said description is not to be construed as limiting of the invention because many changes, modifications and variations may be made therein by those of skill in the art without departing from the essential scope, spirit or intention of the invention. Accordingly, it is intended that the scope of the invention be limited solely by the appended claims.

What we claim is:

1. In a protective glove for a hand, the glove having a thumb receiving section and a thumb stall, a thumb protector fashioned of an impact resistant material, the thumb protector comprising:

a unitary thumb-piece having a distal section and a proximal section, the distal section having a length sufficient to overlie the phalanges of the thumb, the proximal section having a length sufficient to overlie at least the metacarpal bone of the thumb, the distal and proximal sections being joined at an obtuse angle.

2. The thumb protector of claim 1 wherein the geometry of the thumb-piece is generally concave in nature and has a closed distal end, thereby to at least partially enclose the lateral and distal aspects of a thumb received into the thumb stall and the lateral aspects of the soft tissue overlying the first metacarpal bone.

3. In a protective glove for a hand, the glove having a thumb receiving section and a thumb stall, a thumb protector fashioned of an impact resistant material, the thumb protector comprising:

a unitary thumb-piece having a distal section and a proximal section, the distal section having a length sufficient to overlie the phalanges of the thumb, the proximal section having a length sufficient to overlie at least the metacarpal bone of the thumb, the distal and proximal sections being joined at an obtuse angle, said unitary thumb-piece further including a ridge located on the dorsal side of said unitary thumb-piece at the juncture of the distal and proximal sections of said unitary thumb-piece.

* * * * *